US009944424B2

(12) United States Patent
Tetrault et al.

(10) Patent No.: US 9,944,424 B2
(45) Date of Patent: Apr. 17, 2018

(54) METHOD AND APPARATUS FOR APPLYING HEAT TRANSFER LABEL

(71) Applicant: Illinois Tool Works Inc., Glenview, IL (US)

(72) Inventors: Joseph A. Tetrault, Stafford Springs, CT (US); James E. Moore, Manchester, CT (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 235 days.

(21) Appl. No.: 14/144,011

(22) Filed: Dec. 30, 2013

(65) Prior Publication Data

US 2014/0224422 A1 Aug. 14, 2014

Related U.S. Application Data

(60) Provisional application No. 61/764,316, filed on Feb. 13, 2013.

(51) Int. Cl.

| | |
|---|---|
| ***B65C 5/04*** | (2006.01) |
| ***B65C 9/36*** | (2006.01) |
| ***B44C 1/10*** | (2006.01) |
| ***D06Q 1/00*** | (2006.01) |
| ***D06Q 1/10*** | (2006.01) |
| ***D06H 1/00*** | (2006.01) |

(52) U.S. Cl.

CPC ..... *B65C 9/36* (2013.01); *B44C 1/10* (2013.01); *D06H 1/00* (2013.01); *D06Q 1/00* (2013.01); *D06Q 1/10* (2013.01); *B65C 5/04* (2013.01)

(58) Field of Classification Search

CPC ..... B65C 5/04
USPC ..... 156/583.1–583.2, 583.4–583.9
See application file for complete search history.

(56) References Cited

U.S. PATENT DOCUMENTS

| | | | | |
|---|---|---|---|---|
| 2,189,296 | A | 2/1940 | Louis | |
| 3,119,728 | A | 1/1964 | Janapol | |
| 4,576,668 | A * | 3/1986 | Farrelly | A41H 43/04 156/220 |
| 5,474,633 | A * | 12/1995 | Myers | B41F 16/00 156/230 |
| 5,813,772 | A | 9/1998 | Magill | |
| 5,856,267 | A * | 1/1999 | Sherman | B41M 5/035 428/209 |
| 7,465,371 | B2 * | 12/2008 | Bachmann | B30B 15/061 156/583.1 |
| 2007/0084547 | A1 | 4/2007 | Lane | |

OTHER PUBLICATIONS

International Search Report and Written Opinion for PCT/US2014/014822 dated May 13, 2014.

* cited by examiner

*Primary Examiner* — Scott W Dodds
(74) *Attorney, Agent, or Firm* — Levenfeld Pearlstein, LLC

(57) ABSTRACT

A system and a method for applying a heat transfer label to a substrate to minimize dye migration are provided. The system and the method are configured such that a substrate is arranged between a heated plate and the label, such that heat is applied through the substrate.

6 Claims, 1 Drawing Sheet

10
14
18
16
12

14
10
16
12
18

104
100
18
16
102
106

METHOD AND APPARATUS FOR APPLYING HEAT TRANSFER LABEL

BACKGROUND

The present disclosure generally relates to methods and apparatus for applying heat transfer labels, and more particularly to a method and an apparatus for applying a heat transfer label on a fabric material to minimize dye migration.

Heat transfer labels are commonly used in the garment industry to decorate clothing articles with graphic images or to mark them, for example, to identify the manufacture, size, washing instruction and the like. However, dye migration from a fabric to a label that is heat transferred to the fabric has been a well-known problem.

A typical heat transfer label applicator includes a base plate upon which a fabric is placed, and a heated silicone rubber pad arranged above the base plate. A label is placed on the fabric with the adhesive side down facing the fabric. The heated silicone pad is brought down by either mechanical force or pneumatic force onto the backside of the label for a predetermined period of time to facilitate transfer of the label to the fabric. During the heat transfer process, dyes from the fabric often migrate into the label, resulting in undesirable color alteration of the label.

Accordingly, there is a need for an improved method and system for applying heat transfer labels to minimize or eliminate such undesirable dye migration.

BRIEF SUMMARY

A system and a method for applying a heat transfer label to minimize dye migration from a fabric material to the label are provided according to various embodiments of the present disclosure. In one preferred embodiment, a fabric substrate is placed between a heated plate and a label, such that heat is applied to the label through the fabric substrate. A preferred system includes a base plate that can be heated and maintained at a predetermined temperature. In this system, a fabric substrate is placed on the base plate, and a heat transfer label is positioned on the fabric substrate. The system also includes an upper plate that can be pressed against the heated base plate to facilitate heat transfer of the label to the fabric substrate.

In one aspect, a method for applying a heat transfer label to a substrate is provided. The method includes the steps of providing a label applicator system, which includes a first plate and a second plate, placing a substrate on the first plate, and placing a heat transfer label on the substrate, such that the substrate is arranged between the first plate and the heat transfer label. The method further includes the steps of heating the first plate to a predetermined temperature, and pressing together the first plate and the second plate for a predetermined period of time to secure the heat transfer label to the substrate.

In one embodiment, the first plate is a base plate of the label applicator system, and the second plate is configured to work in conjunction with the first plate to apply pressure on the substrate and the heat transfer label placed between the first plate and the second plate. The substrate is placed on the first plate, and the heat transfer label is positioned on the substrate at a desired location. The first plate is heated after the substrate and the heat transfer label are placed on the first plate. The second plate is lowered on top of the heat transfer label and pressed against the first plate until the heat transfer label is secured to the substrate.

In another embodiment, the second plate is a base plate of the label applicator system, and the first plate is configured to work in conjunction with the second plate to apply pressure on the substrate and the heat transfer label placed between the first plate and the second plate. In this embodiment, the heat transfer label is placed on the second plate and the substrate is placed over the heat transfer label on the second plate. The first plate is heated and lowered on top of the substrate and pressed against the second plate until the heat transfer label is secured to the substrate.

For any of the above discussed embodiments, the substrate can be a fabric material.

In another aspect, a heat transfer label applicator system is provided. The heat transfer label applicator system includes a base plate, a second plate, and a heat source operably connected to the base plate. The base plate and the second plate are configured to be pressed together. The base plate has a generally flat top surface such that a substrate can be place on the base plate. Further, the base plate and the heat source are configured such that the base plate can be heated to a predetermined temperature and maintained at that temperature for a predetermined period of time.

In one embodiment, the second plate is configured such that the second plate can be lowered and pressed against the base plate maintaining a predetermined pressure for a predetermined period of time. In some embodiments, the second plate is pneumatically driven to be lowered and pressed against the base plate. Alternatively, the second plate is mechanically driven to be lowered and pressed again the base plate.

Other aspects, objectives and advantages will become more apparent from the following detailed description when taken in conjunction with the accompanying drawings.

BRIEF DESCRIPTION OF THE DRAWINGS

The benefits and advantages of the present embodiments will become more readily apparent to those of ordinary skill in the relevant art after reviewing the following detailed description and accompanying drawings, wherein.

DETAILED DESCRIPTION

Figures 1, 2, 3:
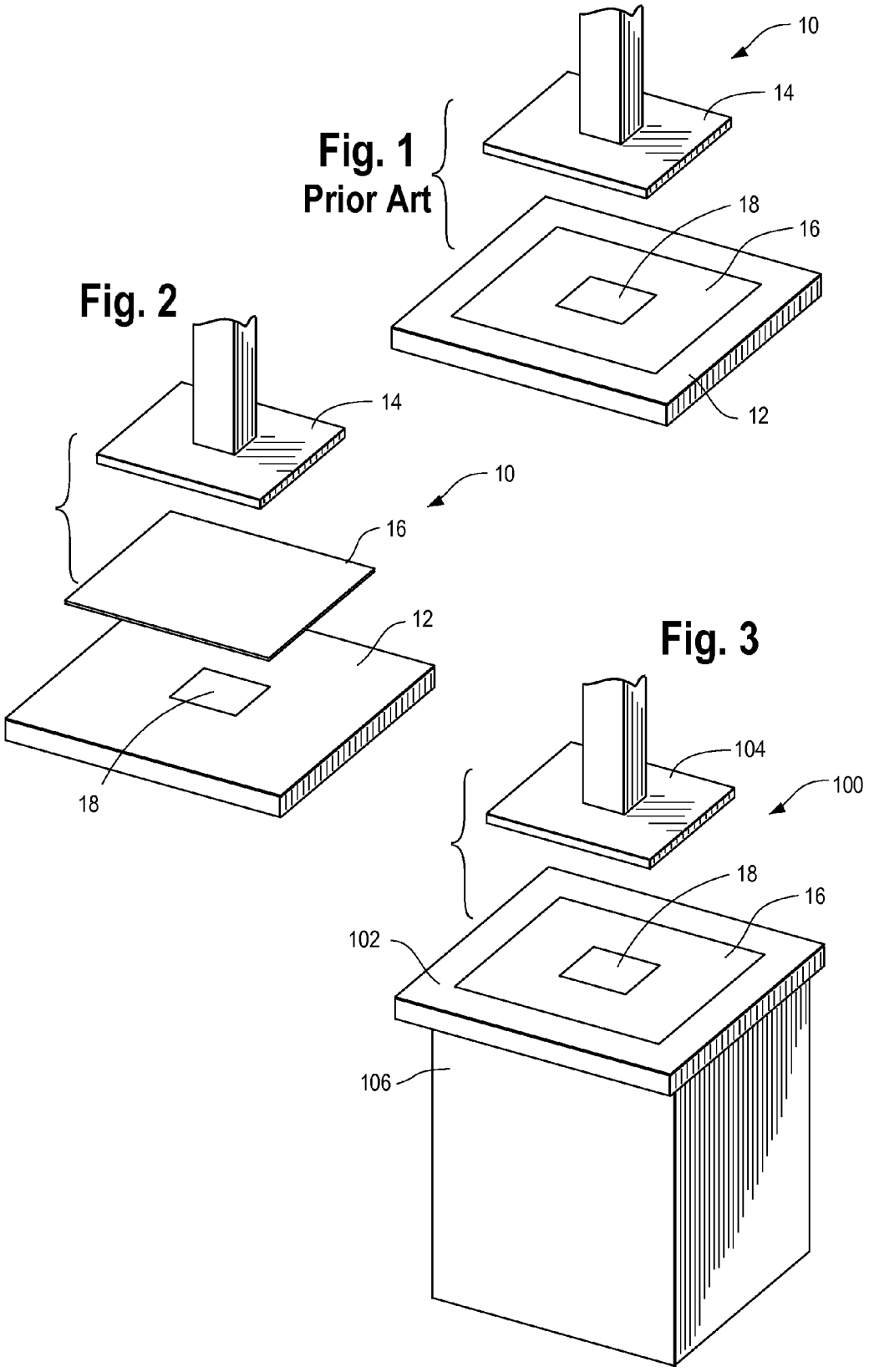
Fig. 1 Prior Art
FIG. 1 is an illustration of a prior art heat transfer label applicator system and method.
FIG. 2 is an illustration of a method of applying a heat transfer label according to an embodiment.
FIG. 3 is an illustration of a heat transfer label applicator system and method according to another embodiment.

While the present disclosure is susceptible of embodiment in various forms, there is shown in the drawings and will hereinafter be described presently preferred embodiments with the understanding that the present disclosure is to be considered an exemplification and is not intended to limit the disclosure to the specific embodiments illustrated. The words "a" or "an" are to be taken to include both the singular and the plural. Conversely, any reference to plural items shall, where appropriate, include the singular.

FIG. 1 is an illustration of a prior art heat transfer label applicator system 10. The system 10 generally includes a base plate 12 and an upper plate 14. Typically, the upper plate 14 includes a silicone rubber pad. Although not shown, the upper plate 14 is provided with a heat source such that it can be heated to a desired temperature. As shown, a fabric 16 is placed on the base plate 12, such that the side of the fabric to be decorated faces up toward the upper plate 14. A heat transfer label 18 is placed on the fabric 16. Once the heat transfer label 18 is positioned at a desired location, the heated upper plate 14 is lowered and pressed on top of the heat transfer label 18 for a predetermined period of time until the heat transfer label 18 is secured on the fabric 16.

During this heat application process, dye from the fabric 16 often migrates to the label 18 causing undesirable color alteration of the label and decoration. The dye migration problem is more prominent when the fabric 16 is colored with sublimation dyes. When the heated upper plate 14 is pressed onto the heat transfer label 18 placed on the fabric 16, some of the dye in the fabric 16 sublimates and migrates toward the heat source, i.e. the heated upper plate 14, and into the label 18.

In an improved method for applying a heat transfer label according to an embodiment of the present disclosure, the heat transfer label 18 is placed on the base plate 12 first with its adhesive side facing up toward the upper plated 14, as shown in FIG. 2. Subsequently, the fabric 16 is placed over the heat transfer label 18 on the base plate 12. In this embodiment, the base plate 12 may be provided with markings to aid placement of the label 18 and the fabric 16, such that the label 18 and the fabric 16 can be positioned appropriately relative to each other according to a desired decoration. Such makings may be necessary as the positioning of the label 18 relative to the fabric 16 is difficult as the label 18 that is placed under the fabric 16 is not visible to an operator. After the fabric 16 is placed over the label 18, the heated upper plate 14 is lowered onto the fabric 16 over the label 18, and pressed to secure the label 18 to the fabric 16.

A first sample was prepared by applying a heat transfer label on a fabric according to the prior art system and method of FIG. 1. A second sample was prepared by applying the same heat transfer label on the same fabric according to the method embodiment of FIG. 2. The first sample and second sample were examined for dye migration. The first sample had a visual grayscale rating of about 3-4, which correlates to unacceptable dye migration for most of the apparel industry, while the second sample had a visual grayscale rating of about 5, which correlates to nearly no dye migration. Thus, the method according to the embodiment of FIG. 2 significantly reduced the undesirable dye migration when compared to the prior art method.

FIG. 3 is an illustration of a heat transfer label applicator system 100 according to an embodiment of the present disclosure. The system 100 is similarly configured to the prior art system 10 of FIG. 1, and generally includes a base plate 102 and an upper plate 104. However, in this embodiment, the base plate 102 is provided with a heat source 106. For label application, a fabric 16 is placed on the base plate 102, such that the side of the fabric to be decorated faces up toward the upper plate 104. A heat transfer label 18 is placed on the fabric 16 and positioned at a desired location. Since the label 18 is visible to an operator, positioning of the label 18 is as easy as with the prior art system and method. The label 18 is positioned at a desired location on the fabric 16, and the base plate 102 is heated to a desired temperature. The upper plate 104 is lowered and pressed onto the top of the heat transfer label 18 for a predetermined period of time until the heat transfer label 18 is secured to the fabric 16. In this embodiment, the heat source, i.e. the heated base plate 102, is arranged adjacent the fabric 16, such that the fabric 16 is between the heat source and the label 16, and heat is applied through the fabric 16. Thus, as it was with the method embodiment of FIG. 2, dye migration from the fabric to the label can be substantially reduced.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover by the appended claims all such modifications as fall within the scope of the claims.

What is claimed is:

1. A heat transfer label applicator system for applying a heat transfer label to a dyed fabric substrate, comprising:

a base plate;

a second plate having a silicone rubber pad;

the dyed fabric substrate;

the heat transfer label, wherein the heat transfer label includes an adhesive side having an adhesive disposed thereon and positioned against the dyed fabric substrate; and a heat source operably connected to the base plate, wherein the dyed fabric substrate is disposed between the base plate and the heat transfer label, wherein the base plate and the second plate are configured to be pressed together with the dyed fabric substrate and the heat transfer label positioned therebetween such that in response to application of heat from the heat source and pressing of the base plate and second plate, the heat transfer label is adhered to the dyed fabric substrate by the adhesive side, wherein the adhesive is disposed on the heat transfer label prior to the application of heat and pressing of the base plate to the second plate, and wherein the second plate is not connected to any heat source such that heat is applied from the base plate only.

2. The heat transfer label applicator system of claim 1, wherein in the base plate has a generally flat top surface and the dyed fabric substrate is positioned on the base plate.

3. The heat transfer label applicator system of claim 1, wherein the base plate and the heat source are configured such that the base plate is heated to a predetermined temperature and maintains the temperature.

4. The heat transfer label applicator system of claim 1, wherein the second plate is configured to be lowered and pressed against the base plate to maintain a predetermined pressure for a predetermined period of time.

5. The heat transfer label applicator system of claim 4, wherein the second plate is pneumatically powered to be lowered and pressed against the base plate.

6. The heat transfer label applicator system of claim 4, wherein the second plate is mechanically powered to be lowered and pressed against the base plate.

* * * * *